US007636969B2

(12) United States Patent
Long et al.

(10) Patent No.: US 7,636,969 B2
(45) Date of Patent: Dec. 29, 2009

(54) SYSTEM AND METHOD TO OCCLUDE PATIENT ENTRAPMENT ZONES

(75) Inventors: Justin Long, San Antonio, TX (US); Maria T. Tejeda, Cibolo, TX (US); John Hanke, Schertz, TX (US); Olga Garibay, San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 21 days.

(21) Appl. No.: 11/953,405

(22) Filed: Dec. 10, 2007

(65) Prior Publication Data

US 2009/0049614 A1 Feb. 26, 2009

Related U.S. Application Data

(60) Provisional application No. 60/957,619, filed on Aug. 23, 2007.

(51) Int. Cl.
*A47C 21/08* (2006.01)

(52) U.S. Cl. ..... 5/624; 5/425; 5/424; 5/732; 5/621

(58) Field of Classification Search ..... 5/424–427, 5/663, 732, 621, 624
See application file for complete search history.

(56) References Cited

U.S. PATENT DOCUMENTS 5,323,500 A 6/1994 Roe et al. ..... 5/710
5,359,740 A * 11/1994 Markley et al. ..... 5/425
6,243,894 B1 6/2001 Kosumsuppamala et al.
6,347,422 B2 2/2002 Heavrin ..... 5/663
6,408,463 B1 * 6/2002 Palacio ..... 5/424
6,427,264 B1 8/2002 Metz et al.
6,629,326 B2 10/2003 Rabe
6,668,399 B2 12/2003 Malstaff et al.
6,704,954 B2 3/2004 Metz et al.
6,721,974 B1 * 4/2004 Wilkinson ..... 5/425
6,820,293 B2 11/2004 Alverson
6,928,673 B2 8/2005 Risk, Jr.
7,107,636 B2 9/2006 Metz et al.
7,127,755 B1 10/2006 Stacy et al.
7,246,388 B2 * 7/2007 DiLiberto, Jr. ..... 5/425

OTHER PUBLICATIONS

International Search Report and Written Opinion, issued in International Application No. PCT/US08/74000, dated Nov. 5, 2008.
FDA, Center for Devices and Radiological Health, "Hospital Bed System Dimensional and Assessment Guidance to Reduce Entrapment," Mar. 10, 2006, p. 12 (www.fda.gov/cdrh/beds/guidance/1537.html).

* cited by examiner

*Primary Examiner*—Fredrick Conley

(57) ABSTRACT

A system and method for occluding potential entrapment zones in a bed. The system includes a head-end assembly with a head-end cover enclosing a head-end pad, and a torso assembly with a pair of covers each enclosing a pair of pads. The system also includes a leg assembly with a cover enclosing pads and a foot-end assembly with covers enclosing pads. The system further includes multiple sets of coupling members that couple the covers together.

18 Claims, 6 Drawing Sheets

SYSTEM AND METHOD TO OCCLUDE PATIENT ENTRAPMENT ZONES

CROSS-REFERENCE TO RELATED APPLICATIONS

This application claims the priority of U.S. Provisional Patent Application Ser. No. 60/957,619, filed Aug. 23, 2007, the entire disclosure of which is specifically incorporated herein by reference.

BACKGROUND INFORMATION

Typical medical support surfaces such as hospital beds comprise a frame, mattress, head board, foot board, and side rails. In certain examples, gaps may exist between the mattress and adjacent components such as the side rails, head board or foot board. In addition, gaps may exist between the side rails, or within the supports that couple the side rails to the frame. The Federal Drug Administration has identified specific zones between components of beds that pose specific risks to patients. See "Hospital Bed System Dimensional and Assessment Guidance to Reduce Entrapment—Guidance for Industry and FDA Staff" issued on Mar. 10, 2006, incorporated herein by reference.

These gaps can pose a risk to a patient supported by the bed because the patient can become entrapped in the gaps. It is therefore desirable to provide a method and system of occluding the gaps from the patient to reduce the likelihood that the patient will become entrapped. However, it is also desirable to provide access for the caregiver to the patient, in case the caregiver needs to assist the patient. Furthermore, it is desirable to allow the patient to enter or exit the bed when desired. Therefore, it is desirable that a method and system of occluding the gaps not restrict access to the patient.

SUMMARY

Certain exemplary embodiments may comprise a pad system comprising: a head-end assembly comprising a head-end cover enclosing a head-end pad; a torso assembly comprising a first cover enclosing a first pair of pads and comprising a second cover enclosing a second pair of pads; a leg assembly comprising a third cover enclosing a third pad and comprising a fourth cover enclosing a fourth pad; a foot-end assembly comprising a foot-end cover enclosing a foot-end pad; a first set of coupling members coupling the head-end cover to the first and second covers; a second set of coupling members coupling the first cover to the third cover; a third set of coupling members coupling the second cover to the fourth cover; and a fifth set of coupling members coupling the foot-end cover to the third and fourth covers. Certain exemplary embodiments comprise a first base sheet coupling the first cover to the second cover and a second base sheet coupling the third cover to the fourth cover. In certain exemplary embodiments, the base sheet may comprise a plurality of apertures. Exemplary embodiments may also comprise a first seam between the base sheet and the first cover and a second seam between the base sheet and the second cover, where the first seam allows the first cover to be pivoted with respect to the base sheet when the first set of coupling members is de-coupled and the second seam allows the second cover to be pivoted with respect to the base sheet when the first set of coupling members is decoupled.

In certain exemplary embodiments, the first and second pairs of pads may be configured to allow articulation of the torso assembly with respect to the leg assembly. In certain exemplary embodiments, the first cover and the second cover comprise an elastic portion configured to expand and contract as the torso assembly is articulated during use. In certain embodiments, the coupling members are buckles.

Certain exemplary embodiments may also comprise method of occluding potential entrapment zones in a hospital bed having a frame, a mattress, side rails, a head board, and a footboard. In certain exemplary embodiments, the method may comprise providing a pad system comprising: a head-end assembly comprising a head-end cover enclosing a head-end pad; a torso assembly comprising a first cover enclosing a first pair of pads and comprising a second cover enclosing a second pair of pads; a leg assembly comprising a third cover enclosing a third pad and comprising a fourth cover enclosing a fourth pad; a foot-end assembly comprising a foot-end cover enclosing a foot-end pad; a first set of coupling members coupling the head-end cover to the first and second covers; a second set of coupling members coupling the first cover to the third cover; a third set of coupling members coupling the second cover to the fourth cover; and a fifth set of coupling members coupling the foot-end cover to the third and fourth covers. The method may also comprise fitting the pad system to the hospital bed, where the head-end pad is placed between the mattress and the head board, the first and second covers are placed between the mattress and the side rails, and the foot-end pad is placed between the mattress and the foot board.

Certain exemplary embodiments may also comprise a bed comprising: a frame; a head board; a foot board; a mattress comprising a head end, a foot end, a first side and a second side; a plurality of side rails coupled to the frame and proximal to the first side and the second side of the mattress; and a pad system. In certain exemplary embodiments, the pad system comprises a plurality of covers enclosing pads and reinforcing members, and the pad system is disposed: between the mattress and the side rails; between the mattress and head board; and between the mattress and the foot board. In certain exemplary embodiments, the cover comprises a coupling member that may be coupled to hold the cover proximal to the mattress or de-coupled to allow the cover to pivot away from the mattress.

BRIEF DESCRIPTION OF THE FIGURES

While exemplary embodiments of the present invention have been shown and described in detail below, it will be clear to the person skilled in the art that changes and modifications may be made without departing from the scope of the invention. As such, that which is set forth in the following description and accompanying drawings is offered by way of illustration only and not as a limitation. The actual scope of the invention is intended to be defined by the following claims, along with the full range of equivalents to which such claims are entitled.

In addition, one of ordinary skill in the art will appreciate upon reading and understanding this disclosure that other variations for the invention described herein can be included within the scope of the present invention. For example, different materials of construction may be used for the pads and covers employed in the pad system. Furthermore, the shape of individual pads may also be altered.

In the following Detailed Description of Disclosed Embodiments, various features are grouped together in several embodiments for the purpose of streamlining the disclosure. This method of disclosure is not to be interpreted as reflecting an intention that exemplary embodiments of the invention require more features than are expressly recited in each claim. Rather, as the following claims reflect, inventive subject matter lies in less than all features of a single disclosed embodiment. Thus, the following claims are hereby incorporated into the Detailed Description of Exemplary Embodiments, with each claim standing on its own as a separate embodiment.

Figure 1:
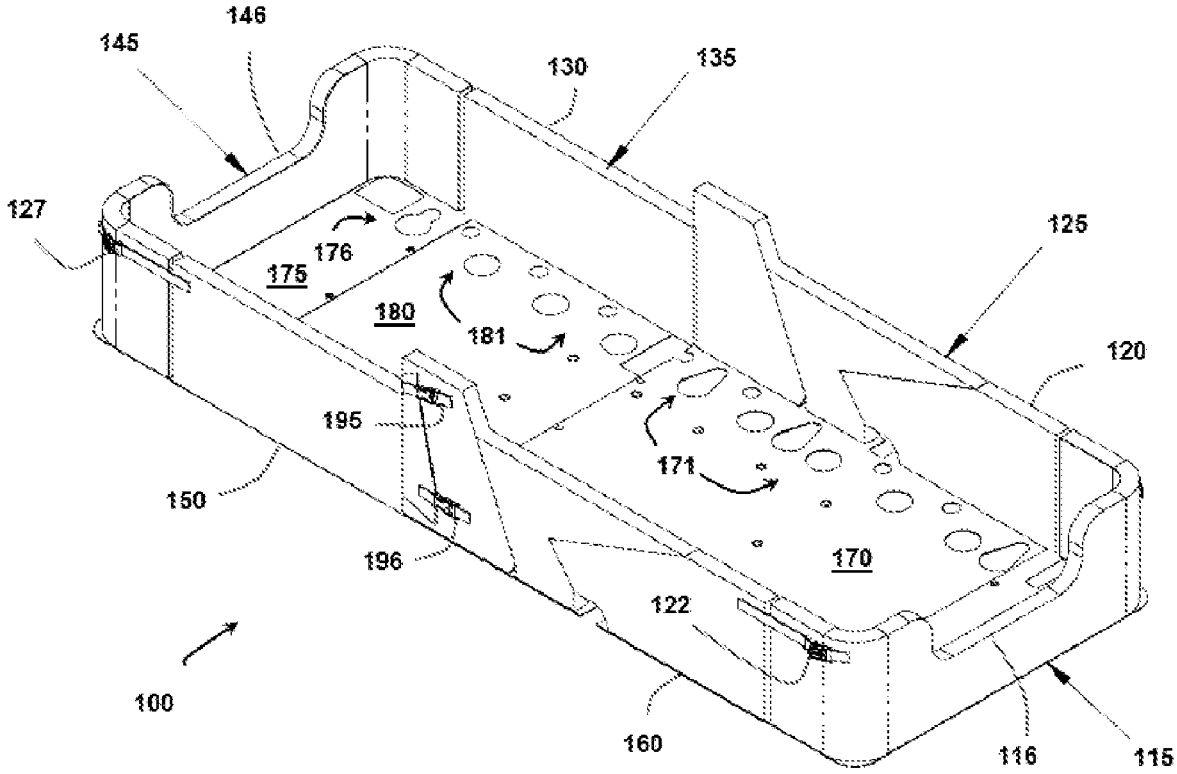

FIG. 1 is an assembly view of one non-limiting, exemplary embodiment of a pad system.

Figure 2:
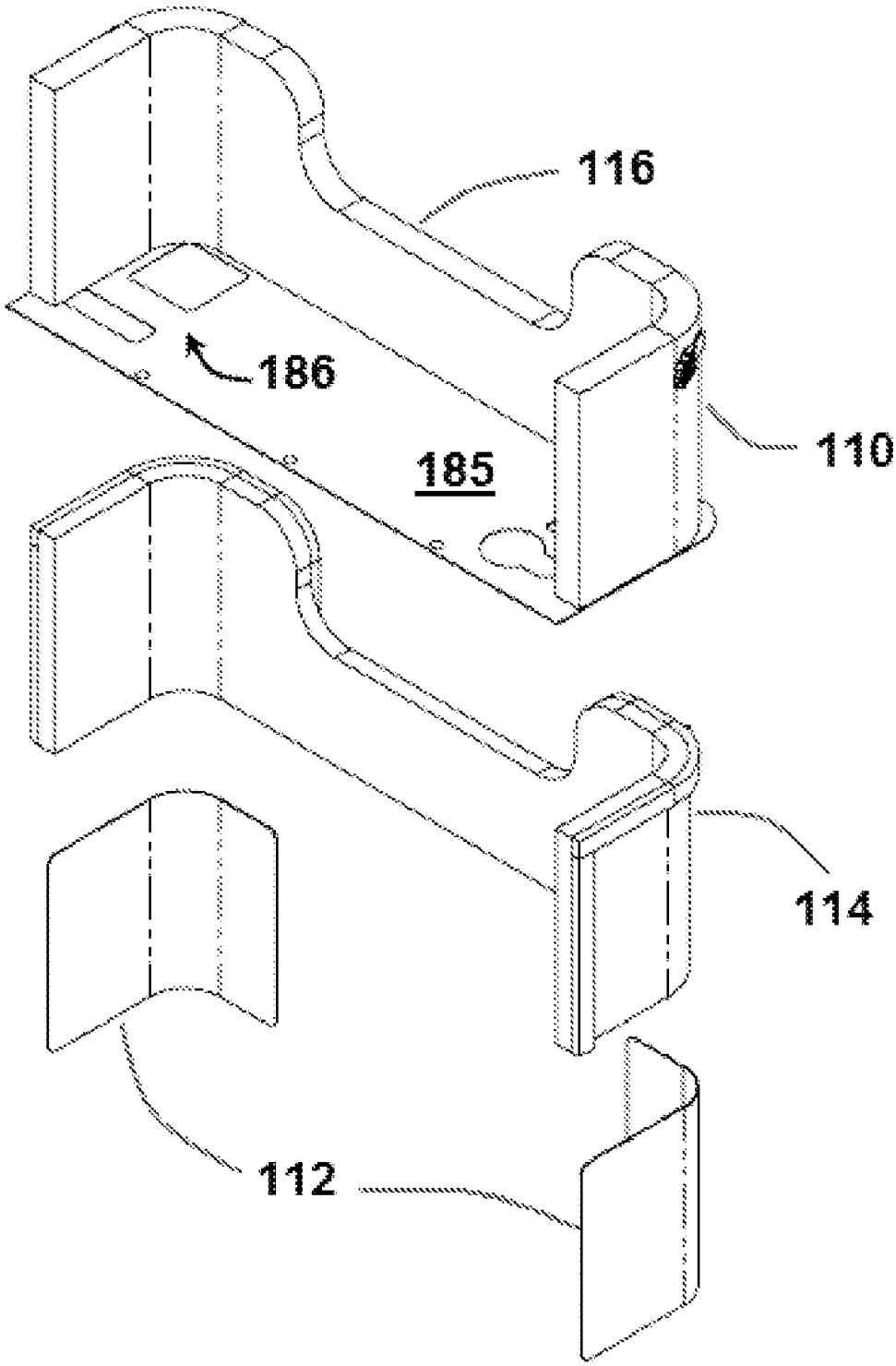

FIG. 2 is an exploded view of a portion of the embodiment of FIG. 1.

Figure 3:
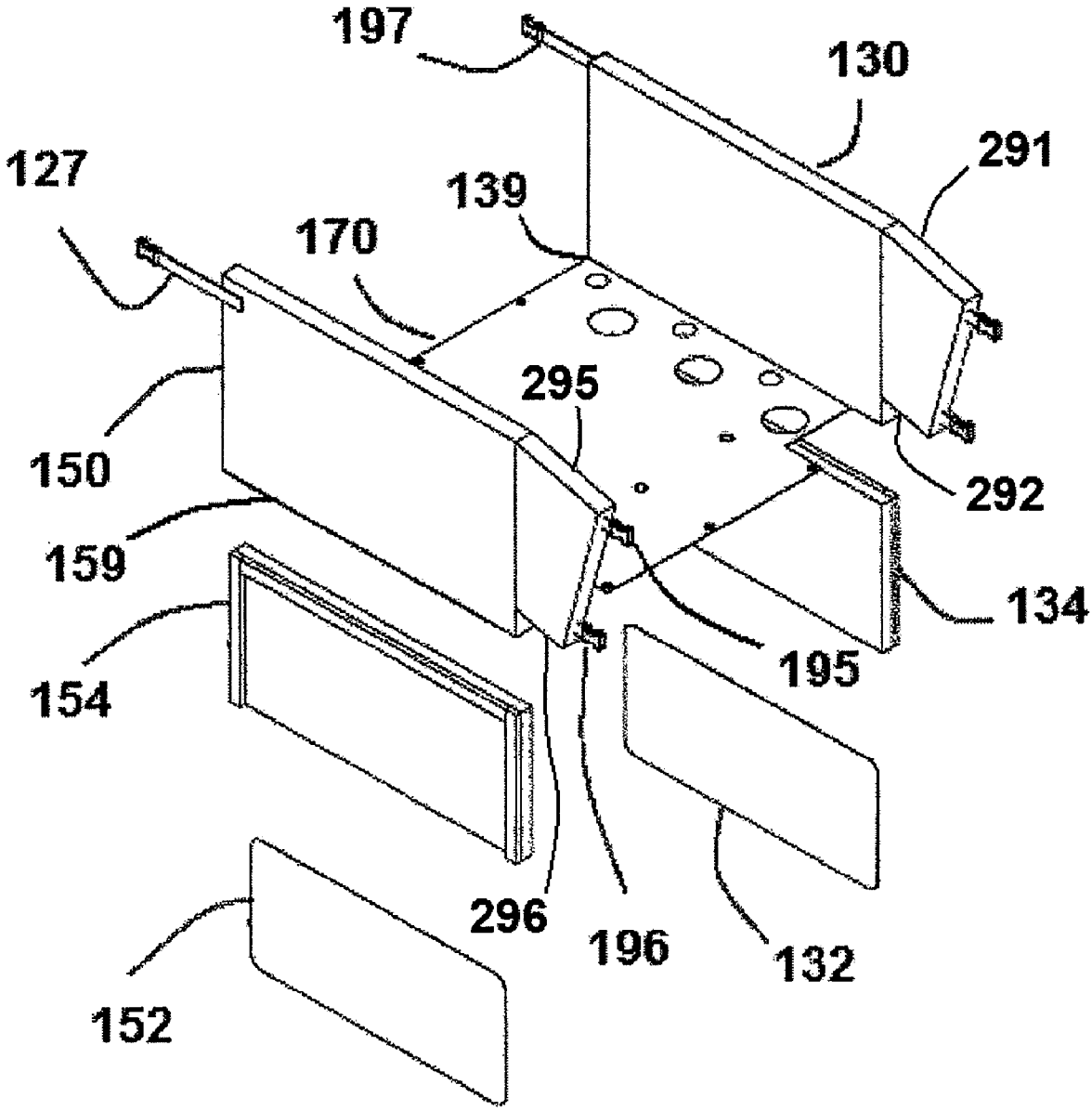

FIG. 3 is an exploded view of a portion of the embodiment of FIG. 1.

Figure 4:
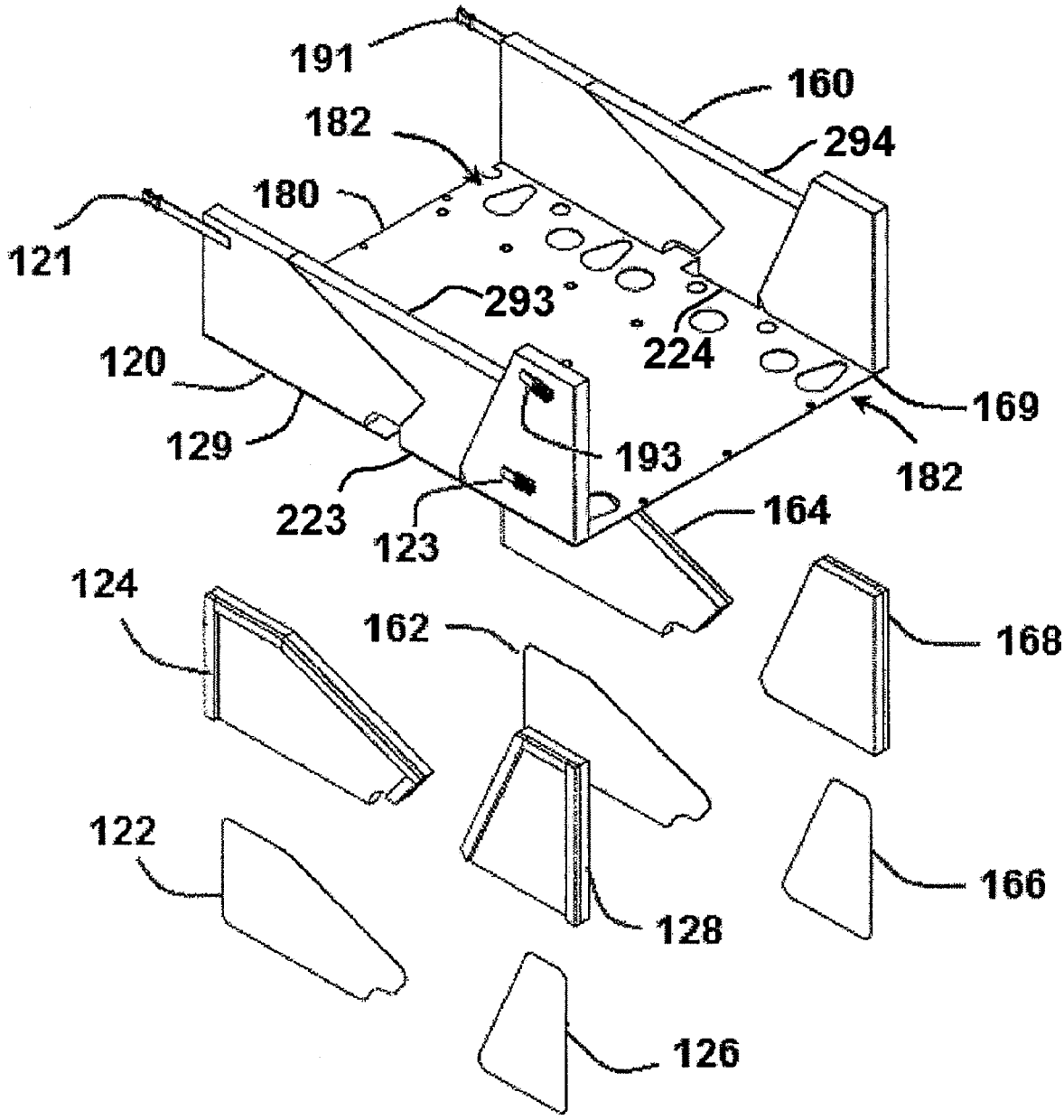

FIG. 4 is an exploded view of a portion of the embodiment of FIG. 1.

Figure 5:
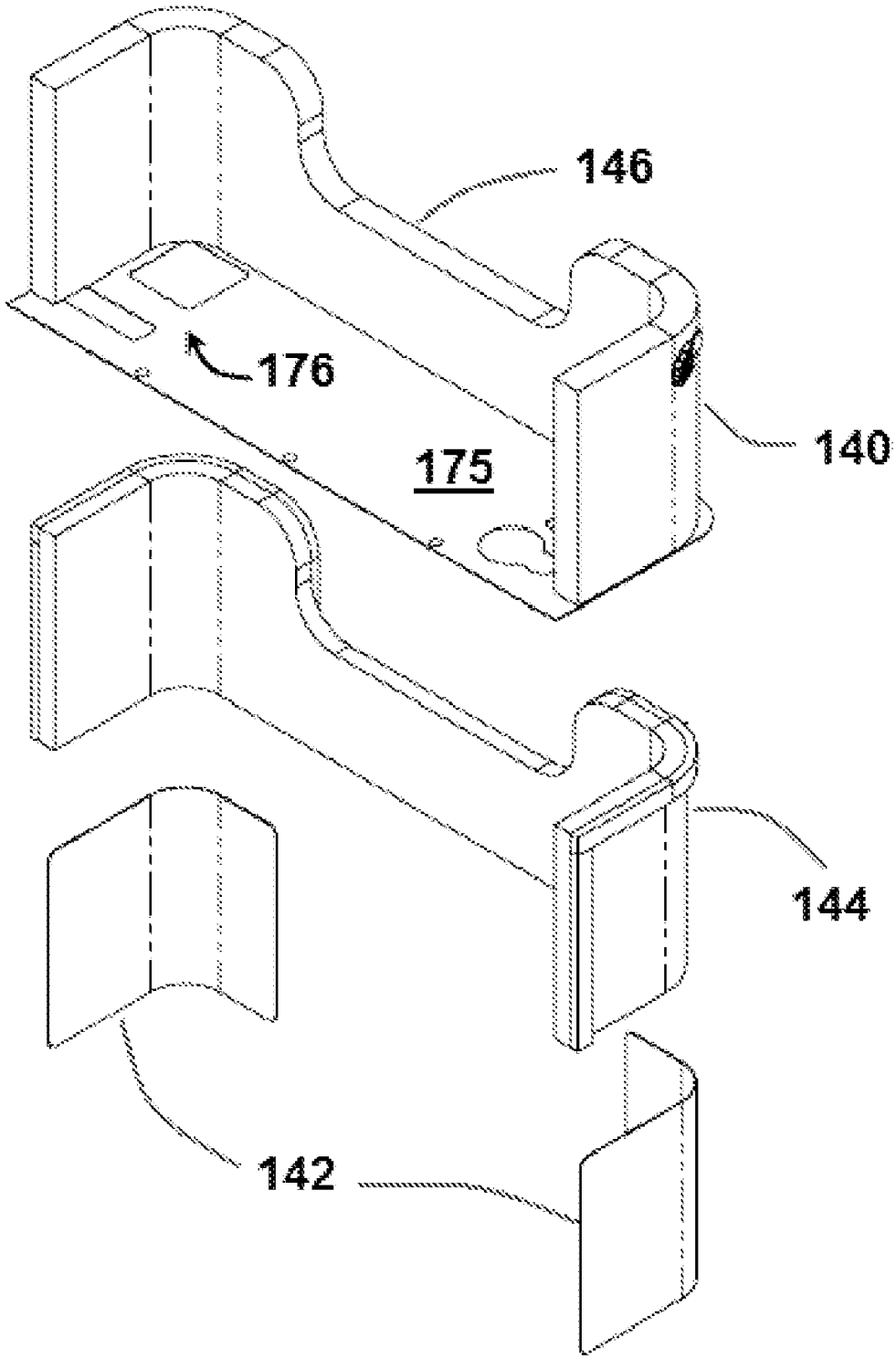

FIG. 5 is an exploded view of a portion of the embodiment of FIG. 1.

Figure 6:
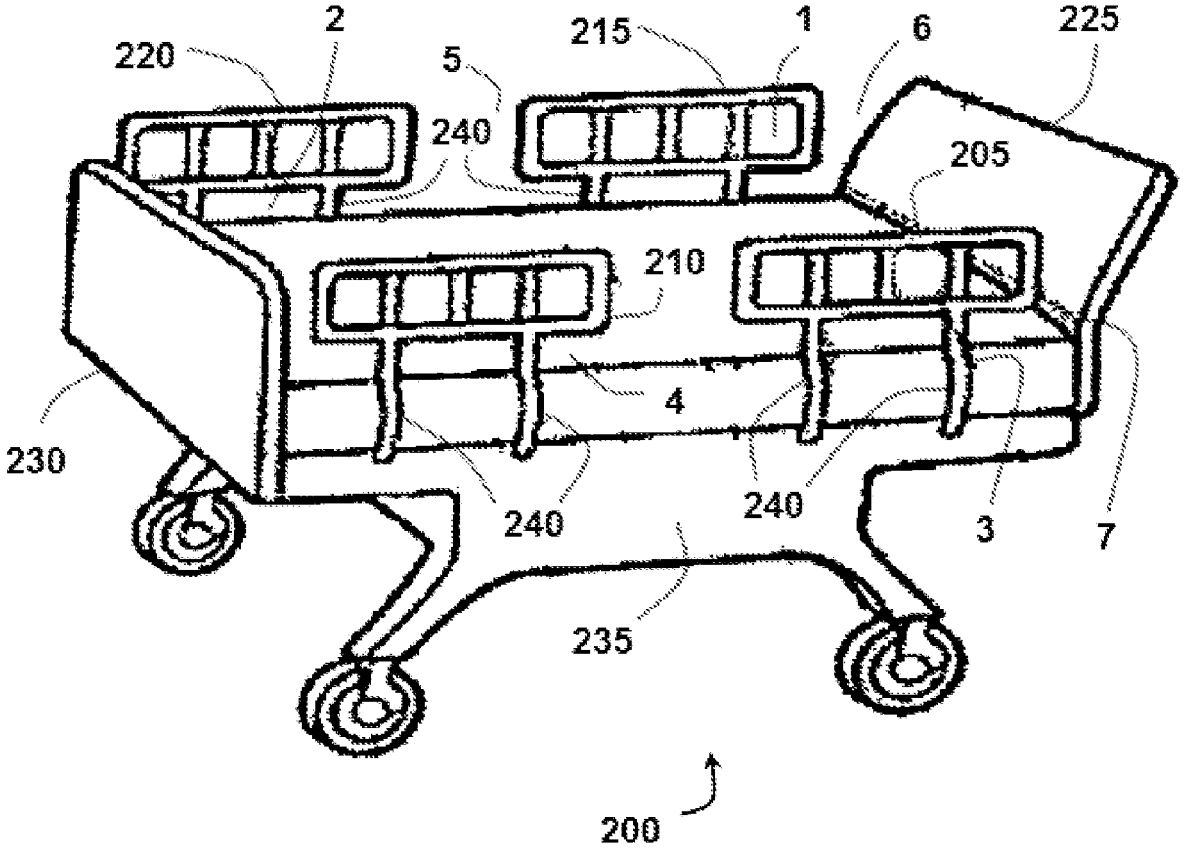

FIG. 6 is a perspective view of a bed to which the embodiment of FIG. 1 may be fitted.

DETAILED DESCRIPTION OF EXEMPLARY EMBODIMENTS

Referring now to the exemplary embodiment shown in FIGS. 1-5, a pad system 100 comprises a head-end assembly 115, a torso assembly 125, a leg assembly 135, and a foot-end assembly 145. Head-end assembly 115 further comprises a pair of end members 112, a pad 114, and a cover 110. Foot-end assembly 145 similarly comprises a pair of end members 142, a pad 144, and a cover 140. Torso assembly 125 comprises a pair of covers 120, 160 that are coupled by a base sheet 180 comprising a plurality of openings 182.

In certain exemplary embodiments, a cover 120 encloses an upper pad 124 and a reinforcing member 122 in the portion of cover 120 that is proximal to head assembly 115. Similarly, cover 160 encloses an upper pad 164 and a reinforcing member 162 in the portion of cover 160 that is proximal to head assembly 115. Cover 120 also encloses a pad 128 and a reinforcing member 126 in the portion of cover 120 that is proximal to leg assembly 135. Similarly, cover 160 encloses a pad 168 and a reinforcing member 166 in the portion of cover 160 that is proximal to leg assembly 135. Cover 130 of leg assembly 135 encloses a pad 134 and a reinforcing member 132, while cover 150 of leg assembly 135 encloses a pad 154 and a reinforcing member 152. Cover 140 of foot assembly 145 encloses a pair of end members 142 and a pad 144, which are equivalent to end members 112 and pad 114, respectively. Pads 154, 164, and 168 are equivalent to pads 134, 124 and 128 respectively. Similarly, reinforcing members 152, 162, and 166 are equivalent to reinforcing members 132, 122 and 126.

In certain exemplary embodiments, each of the pads comprised in pad system 100 is made from an antimicrobial foam and reinforcing members are made from a rigid plastic. In certain exemplary embodiments, covers 110, 120, 130, 140, 150, and 160 are comprised of flame resistant, polyester reinforced, anti-bacterial vinyl fabric (such as a material sold under the trade name Staph-Check). In certain exemplary embodiments, covers 110, 120, 130, 140, 150, and 160 may also comprise a coating of 0.030 inch polypropylene.

Referring now to the exemplary embodiment shown in FIG. 6, a bed 200 comprises a left side upper side rail 205, a left side lower side rail 210, a right side upper side rail 215 and a right side lower side rail 220. Bed 200 also comprises a head board 225 and a foot board 230 at each end of a frame 235 that supports a mattress 237. Rail supports 240 extend between each rail 205, 210, 215, 220 and frame 235.

As noted in FDA guidelines "Hospital Bed System Dimensional and Assessment Guidance to Reduce Entrapment—Guidance for Industry and FDA Staff", a bed such as bed 200 comprises several potential entrapment zones in which a person supported by bed 200 could potentially become entrapped. A zone 1 exists within each of rails 205, 210, 215 and 220, while a zone 2 exists under rails 205, 210, 215, 220 (and between rail supports 240). A zone 3 exists between rails 205, 210, 215, 220 and mattress 237. A zone 4 exists at each end of rail 205, 210, 215, 220, while a zone 5 exists between rails 205 and 210, as well as between rails 215 and 220. A zone 6 exists between the ends of rails 205, 210, 215, 220 and the ends of head board 225 and foot board 230. A zone 7 exists between mattress 237 and both head board 225 and foot board 230.

In certain exemplary embodiments, pad system 100 is configured to be fitted to bed 200 in a manner that reduces the likelihood that a person could be entrapped in one of the seven zones identified by the FDA. Specifically, pad system 100 is configured to place pads in the zones and restrict access to the area or zone identified by the FDA as a potential location of entrapment. For example, pads 124, 128 and 134 are configured to be placed in zones 1-6 on the right side of bed 200, while pads 164, 168 and 154 are located in zones 1-6 on the left side of bed 200. In addition, pads 114 and 144 are configured to be placed in zone 7 between mattress 237 and head board 225 and foot board 230.

As shown in the exemplary embodiment of FIG. 4, pads 124, 128, 164 and 168 are configured so that bed 200 can be articulated to raise the portion of bed 200 proximal to head board 225. This allows bed 200 to be positioned as desired with minimal interference from pad system 100. In addition, covers 120, 160, 130, and 150 are configured to allow articulation of bed 200. For example, covers 120 and 160 may provide extra material with integral elastic 223, 293 and 224, 294 between the pads 124 and 128 as well as pads 164 and 168. This allows covers 120 and 160 to expand or contract as needed depending on the articulation of bed 200. Similarly, covers 130 and 150 may comprise extra material with integral elastic 291, 292 and 295, 296 proximal to the portion that is coupled to covers 120 and 160, thereby allowing covers 130 and 150 to expand or contract as needed.

Referring now to the exemplary embodiment in FIGS. 1, 3 and 4, a series of coupling mechanisms are shown to couple covers 110, 120, 130, 140, 150 and 160. For example, coupling mechanisms 121 and 191 are used to couple covers 120 and 160, respectively, to cover 110. Coupling mechanisms 123 and 193 are used to couple cover 120 to cover 130 and coupling mechanisms 195 and 196 (not visible in FIG. 4) are used to couple cover 160 to cover 150. It is understood that covers 120 and 160 are generally equivalent (as are covers 130 and 150), and that not all coupling mechanisms are visible in the views shown. Coupling mechanisms 127 and 197 are used to couple covers 130 and 150, respectively, to cover 140. In certain exemplary embodiments, the coupling mechanisms can be buckle arrangements. In other exemplary embodiments, the coupling mechanisms can be snap mechanisms or a hook and loop arrangements.

In certain exemplary embodiments, coupling mechanisms 121-128 allow covers 110, 120, 130, 140, 150 and 160 to be de-coupled from each other if needed. This allows a cover (and the associated pads and reinforcing members) to be lowered to provide a caregiver better access to a patient. Such access can be needed, for example, when performing functions such as cardiopulmonary resuscitation (CPR) or other critical care functions. In certain exemplary embodiments, pad system 100 is configured to fit between mattress 237 and side rails 205, 210, 215, 220 to allow any of side rails 205, 210, 215, 220 to be lowered while pad system 100 is in place. The ability to lower or articulate the side rails with pad system 100 in place can further provide the caregiver with access to the patient. The ability to lower covers 110, 120, 130, 140, 150 and 160 while pad system 100 is in place also allows a person to more easily enter or exit bed 200 when necessary.

Referring now to the exemplary embodiment shown in FIGS. 2 and 4, head-end assembly 115 and foot-end assembly 145 comprise a recessed area 116 and 146, respectively. Recessed areas 116 and 146 also provide a caregiver access to a patient being supported by bed 200.

Referring now to the exemplary embodiment of FIGS. 1-5, a base sheet 170 extends between covers 130 and 150, while a base sheet 180 extends between covers 120 and 160. A seam 139 couples base sheet 170 to cover 130, while a seam 159 couples base sheet 170 to cover 150. Seam 139 allows cover 130 to pivot downward so that cover 130 can be lowered, while seam 159 allows cover 150 to pivot downward so that cover 150 can be lowered. The flexible nature of seams 139 and 159 allows covers 130 and 150 to be lowered while pad system 100 is installed on bed 200. Similarly, a seam 129 couples base sheet 180 to cover 120, while a seam 169 couples base sheet 180 to cover 160. Seams 129 and 169 allow covers 120 and 160, respectively, to pivot downward so that they can be lowered while pad system 100 is in place on bed 200. Cover 140 comprises a base sheet 175 extending between end members 142, while cover 110 comprises a base sheet 185 extending between end members 112. In certain exemplary embodiments, base sheets 170, 175, 180 and 185 comprise a series of apertures 171, 176, 181 and 186, respectively, which allow various connections (for example, air cushion connections) to pass through the base sheets.

The invention claimed is:

1. A pad system comprising:

a head-end assembly comprising a head-end cover enclosing a head-end pad;

a torso assembly comprising a first cover enclosing a first pair of pads and comprising a second cover enclosing a second pair of pads;

a leg assembly comprising a third cover enclosing a third pad and comprising a fourth cover enclosing a fourth pad;

a foot-end assembly comprising a foot-end cover enclosing a foot-end pad;

a first coupling member coupling the head-end cover to the first and second covers;

a second coupling member coupling the first cover to the third cover;

a third coupling member coupling the second cover to the fourth cover; and a fourth coupling member coupling the foot-end cover to the third and fourth covers, wherein the third cover and the fourth cover comprise an elastic portion configured to expand when the leg assembly or torso assembly is articulated.

2. The pad system of claim 1 further comprising a first base sheet coupling the first cover to the second cover and a second base sheet coupling the third cover to the fourth cover.

3. The pad system of claim 2 wherein the first base sheet or the second base sheet comprises a plurality of apertures.

4. The pad system of claim 2 further comprising a first seam between the first base sheet and the first cover and a second seam between the second base sheet and the second cover, wherein the first seam allows the first cover to be pivoted with respect to the first base sheet when the first coupling member is de-coupled and the second seam allows the second cover to be pivoted with respect to the second base sheet when the first coupling member is decoupled.

5. The pad system of claim 1 wherein the first and second pairs of pads are configured to allow articulation of the torso assembly with respect to the leg assembly.

6. The pad system of claim 1 wherein the first cover and the second cover comprise an elastic portion configured to expand and contract as the torso assembly is articulated during use.

7. The pad system of claim 1 wherein the first, second, third, and fourth coupling members comprise buckles.

8. The pad system of claim 1 wherein the head-end pad, the foot end pad, the first pair of pads, or the second pair of pads comprise antimicrobial foam.

9. The pad system of claim 1 wherein the head-end cover, the first cover, the second cover, the third cover, the fourth cover or the foot-end cover comprise an anti-bacterial vinyl fabric.

10. The pad system of claim 1 wherein the head-end cover, the first cover, the second cover, the third cover, the fourth cover or the foot-end cover comprise polypropylene.

11. The pad system of claim 1 wherein an upper portion of the head-end assembly or the foot-end assembly comprises a recessed portion.

12. A method of occluding potential entrapment zones in a hospital bed having a frame, a mattress, side rails, a head board, and a footboard, the method comprising:

providing a pad system comprising:

a head-end assembly comprising a head-end cover enclosing a head-end pad;

a torso assembly comprising a first cover enclosing a first pair of pads and comprising a second cover enclosing a second pair of pads;

a leg assembly comprising a third cover enclosing a third pad and comprising a fourth cover enclosing a fourth pad, wherein the third cover and the fourth cover comprise an elastic portion configured to expand when the leg assembly or torso assembly is articulated;

a foot-end assembly comprising a foot-end cover enclosing a foot-end pad;

a first coupling member coupling the head-end cover to the first and second covers a second coupling member coupling the first cover to the third cover;

a third coupling member coupling the second cover to the fourth cover; and a fourth coupling member coupling the foot-end cover to the third and fourth covers; and fitting the pad system to the hospital bed, wherein the head-end pad is placed between the mattress and the head board, the first, second, third, and fourth covers are placed between the mattress and the side rails, and the foot-end pad is placed between the mattress and the foot board.

13. A bed comprising:

a frame;

a head board;

a foot board;

a mattress comprising a head end, a foot end, a first side and a second side;

a plurality of side rails coupled to the frame and proximal to the first side and the second side of the mattress; and a pad system, wherein:

the pad system comprises a plurality of covers enclosing pads, wherein at least one of the plurality of covers comprises an elastic portion configured to expand when the frame is articulated;

the pad system is disposed:

between the mattress and the side rails;

between the mattress and head board; and between the mattress and the foot board; and a cover comprises a coupling member that may be coupled to hold the cover proximal to the mattress or de-coupled to allow the cover to pivot away from the mattress.

14. The bed of claim 13 wherein the head board may be raised with respect to the foot board during use, thereby stretching the elastic portion.

15. The bed of claim 13 wherein at least one side rail may be lowered without removing the pad system.

16. The bed of claim 13 wherein a portion of the pad system disposed between the mattress and the foot board comprises a recessed portion.

17. The bed of claim 13 wherein a portion of the pad system disposed between the mattress and the head board comprises a recessed portion.

18. The bed of claim 13 wherein at least one cover may be pivoted away from the mattress.

* * * * *